US008621763B2

(12) United States Patent
Park et al.

(10) Patent No.: US 8,621,763 B2
(45) Date of Patent: Jan. 7, 2014

(54) FABRIC TREATMENT APPARATUS

(75) Inventors: Dae Yun Park, Seoul (KR); Jong Seok Kim, Seoul (KR); Dong Won Kim, Seoul (KR); Sog Kie Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 399 days.

(21) Appl. No.: 12/461,654

(22) Filed: Aug. 19, 2009

(65) Prior Publication Data

US 2010/0043247 A1 Feb. 25, 2010

(30) Foreign Application Priority Data

Aug. 20, 2008 (KR) ..... 10-2008-0081478

(51) Int. Cl.
*F26B 25/06* (2006.01)
*F26B 25/08* (2006.01)

(52) U.S. Cl.
USPC ..... 34/202; 34/218; 34/239

(58) Field of Classification Search
USPC ..... 34/201, 202, 218, 239, 240; 211/113, 211/115, 116, 119.12
See application file for complete search history.

(56) References Cited

U.S. PATENT DOCUMENTS

| | | | | |
|---|---|---|---|---|
| 3,670,425 | A * | 6/1972 | Benjamin et al. | 34/542 |
| 5,152,077 | A * | 10/1992 | Liang | 34/77 |
| 5,485,791 | A * | 1/1996 | Lubbecke et al. | 104/172.4 |
| 6,085,916 | A * | 7/2000 | Kovacevic et al. | 211/86.01 |
| 7,235,109 | B2 * | 6/2007 | Kleker | 34/202 |
| 8,132,339 | B2 * | 3/2012 | Moon et al. | 34/601 |
| 2008/0000863 | A1 * | 1/2008 | DiBello | 211/134 |

FOREIGN PATENT DOCUMENTS

| | | | |
|---|---|---|---|
| CN | 201071468 | Y * | 6/2008 |
| JP | 08-280999 | | 10/1996 |
| JP | 10-080331 | | 3/1998 |
| KR | 10-2008-0001854 | | 1/2008 |
| KR | 10-2008-0056507 | | 6/2008 |

* cited by examiner

*Primary Examiner* — Jiping Lu
(74) *Attorney, Agent, or Firm* — McKenna Long & Aldridge LLP

(57) ABSTRACT

A fabric treatment apparatus is provided. The fabric treatment apparatus includes a treatment room adapted to receive laundry to be treated; a rack disposed in the treatment room, and adapted to support a plurality of hangers to hang the laundry; one or more electromagnets to apply attraction and repulsion to the clothes rack; and a heating unit adapted to supply at least one of hot air and steam into the treatment room.

20 Claims, 4 Drawing Sheets

FABRIC TREATMENT APPARATUS

CROSS-REFERENCE TO RELATED APPLICATION

This application claims priority from Korean Patent Application No. 10-2008-0081478 filed on Aug. 20, 2008 in the Korean Intellectual Property Office, the disclosure of which is incorporated herein by reference in its entirety.

BACKGROUND OF THE INVENTION

1. Field of the Invention

The present invention relates to a fabric treatment machine, and more particularly, to a fabric treatment machine which can effectively treat clothes by properly moving the clothes.

2. Description of the Related Art

Fabric treatment apparatuses include various types of apparatuses for use in homes or in laundries or cleaners for managing or treating clothes such as washing, drying, or smoothing out the clothes such as a washing machine for washing clothes, a dryer for drying wet laundry, a washer dryer equipped with both a washing function and a dryer function, a refresher for refreshing clothes, and a steamer for smoothing out clothes.

In particular, the refresher is a device for refreshing clothes by drying the clothes, perfuming the clothes, preventing the clothes from getting static, or smoothing out the clothes. The steamer is a device for smoothing out clothes by supplying steam. The steamer, unlike an iron, does not involve applying a hot plate onto clothes and may thus be able to smooth out clothes more delicately than an iron.

A fabric treatment apparatus into which the functions of a refresher and a steamer are incorporated may smooth out or deodorize clothes held therein by using steam and hot air. By using this type of fabric treatment apparatus, it is possible to effectively deodorize clothes and offer the benefits of ironing out clothes.

SUMMARY OF THE INVENTION

The present invention provides a fabric treatment apparatus in which a clothes rack can be moved.

The present invention also provides a fabric treatment apparatus which can improve the efficiency of treatment of clothes by moving a clothes rack therein.

According to an aspect of the present invention, there is provided a fabric treatment apparatus including a treatment room adapted to receive laundry to be treated; a rack disposed in the treatment room, and adapted to support a plurality of hangers to hang the laundry; one or more electromagnets to apply attraction and repulsion to the clothes rack; and a heating unit adapted to supply at least one of hot air and steam into the treatment room.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE ILLUSTRATED EMBODIMENT

Figure 1:
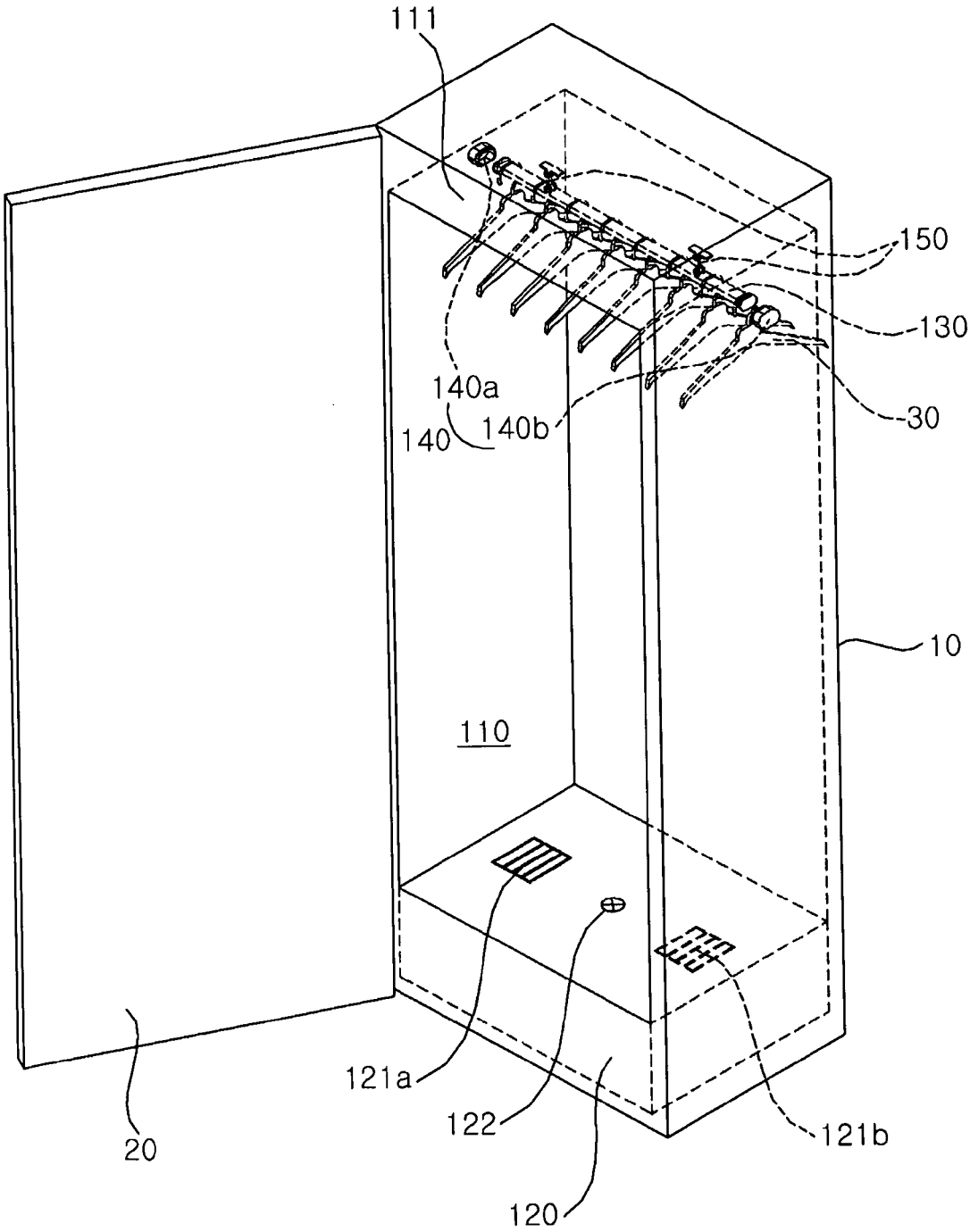
FIG. 1 illustrates a perspective view of a fabric treatment apparatus according to an exemplary embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. Like reference numerals in the drawings denote like elements.

Fabric treatment apparatuses according to exemplary embodiments of the present invention will hereinafter be described in detail with reference to FIGS. 1 through 7.

Figure 2:
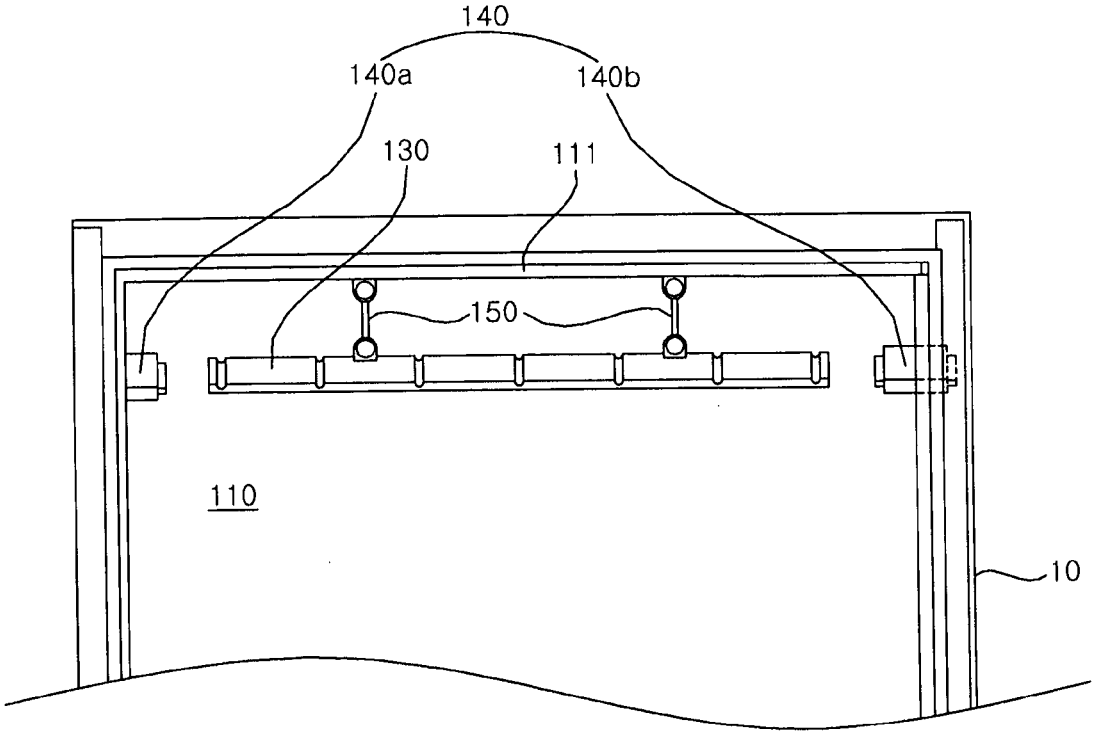
FIG. 2 illustrates a partial front view of the fabric treatment apparatus shown in FIG. 1.

FIG. 1 illustrates a perspective view of a fabric treatment apparatus according to an exemplary embodiment of the present invention, and FIG. 2 illustrates a partial view of the fabric treatment apparatus shown in FIG. 1. Referring to FIGS. 1 and 2, the fabric treatment apparatus may include a treatment room 110 in which clothes are contained, a heating unit 120 which supplies at least one of hot air and steam into the treatment room 110, a clothes rack 130 on which a plurality of hangers 30 for clothes are hung up, and one or more electromagnets 140 which move the clothes rack 130 reciprocally in a linear path.

The treatment room 110 may provide room for holding clothes. The treatment room 110 may be provided in a cabinet 10, which forms the exterior of the treatment room 110. There may be provided an empty space between the treatment room 110 and the cabinet 10. The electromagnets 140 may be disposed on either inner side of the treatment room 110.

One side of the treatment room 110 may be open, and the treatment room 110, and a door 20 may open or close the open side of the treatment room 110. When the door 20 is closed, the treatment room 110 may be isolated from the outside of the fabric treatment apparatus. When the door 20 is open, the treatment room 110 may be exposed. A user may open the door 20, may put clothes in the treatment room 110, may close the door 20 and may operate the fabric treatment apparatus.

An air outlet 121*a* through which air in the treatment room 110 can be ejected from the treatment room 110, a hot air inlet 121*b* through which hot air can be injected into the treatment room 110 and a steam injection hole 122 through which steam can be injected into the treatment room 110 may be provided in the treatment room 110. Connectors 150 may be provided at the ceiling 111 of the treatment room 110 and may be connected to the clothes rack 130.

The heating unit 120 may be provided below the treatment room 110, and may supply hot air and/or steam into the treatment room 110. The heating unit 120 may be implemented in various manners by one of ordinary skill in the art to which the present invention pertains. For example, the heating unit 120 may be implemented as an electric heater or a heat pump.

The heating unit 120 may suck air from the treatment room 110, heat the air, and may supply the heated air into the treatment room 110. In addition, the heating unit 120 may be supplied with water, may generate steam by heating the water, and may inject the steam into the treatment room 110. The heating unit 120 may supply both hot air and steam into the treatment room 110 at the same time.

The heating unit 120 may include the air outlet 121*a* through which air in the treatment room 110 can be ejected from the treatment room 110, the hot air inlet 121*b* through which hot air can be injected into the treatment room 110 and the steam injection hole 122 through which steam can be injected into the treatment room 110.

A plurality of hangers 30 for clothes may be hung up on the clothes rack 130. A plurality of grooves may be formed on the clothes rack 130 so that the hangers 30 can be properly hung up on the clothes rack 130. When the clothes rack 130 reciprocally moves in a linear path, the hangers 30 may also reciprocally move along with the clothes rack 130.

The clothes rack 130 may be moved reciprocally in a linear path by the electromagnets 140, and particularly, by electromagnetic force generated by the electromagnets 140.

In order to properly apply electromagnetic force to the clothes rack 130, the clothes rack 130 may be at least partially formed of a metallic material. More specifically, either end of the clothes rack 130 may be formed of a metallic material. The clothes rack 130 may include one or more permanent magnets which can generate electromagnetic force in association with the electromagnets 140. The permanent magnets may be disposed at either end of the clothes rack 130.

The clothes rack 130 may be connected to a ceiling 111 of the treatment room 110 by connectors 150.

The electromagnets 140 may generate electromagnetic force and may thus reciprocally move the clothes rack 130 in a linear path. The electromagnets 140 may be disposed at various locations. The electromagnets 140 may be disposed close to metallic portions, if any, of the clothes rack 130 or the permanent magnets included in the clothes rack 130. Alternatively, the electromagnets 140 may be disposed outside the treatment room 110.

The electromagnets 140 may apply electromagnetic force, and particularly, attraction or repulsion, to the clothes rack 130. The electromagnets 140 may include first and second electromagnets 140*a* and 140*b*. The first and second electromagnets 140*a* and 140*b* may alternately apply attraction or repulsion to the clothes rack 130 and may thus reciprocally move the clothes rack 130 in a linear path. Alternatively, the first and second electromagnets 140*a* may apply attraction and repulsion, respectively, to the clothes rack 130 at the same time and may thus reciprocally move the clothes rack 130 in a linear path.

The electromagnets 140 may be electromagnetic actuators. In this case, the electromagnets 140 may strike a direct blow to the clothes rack 130 and may thus reciprocally move the clothes rack 130 in a linear path.

The electromagnets 140 may be linear motors. In this case, the electromagnets 140 may transmit a linear motion to the clothes rack 130 and may thus reciprocally move the clothes rack 130 in a linear path.

In the exemplary embodiment of FIGS. 1 and 2, the clothes rack 130 may be moved reciprocally in a linear path by using the electromagnets 140, but the present invention is not restricted to this. That is, various sources of power other than the electromagnets 140 may be used to reciprocally move the clothes rack 130 in a linear path.

Figure 3:
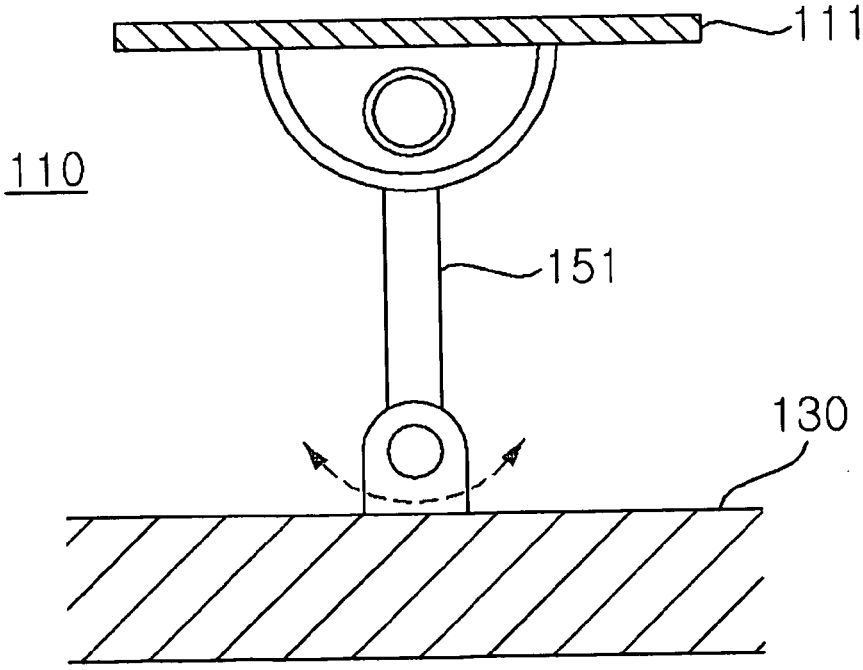
FIG. 3 illustrates a connector of the fabric treatment apparatus shown in FIG. 1.

FIG. 3 illustrates one of the connectors 150 of the fabric treatment apparatus shown in FIG. 1. Referring to FIGS. 1 through 3, the fabric treatment apparatus may also include the connectors 150 connecting the clothes rack 130 to the top of the treatment room 110. The connectors 150 may be rotatably coupled to the ceiling 111 of the treatment room 110. In addition, the connectors 150 may be rotatably coupled to the clothes rack 130.

Figure 4:
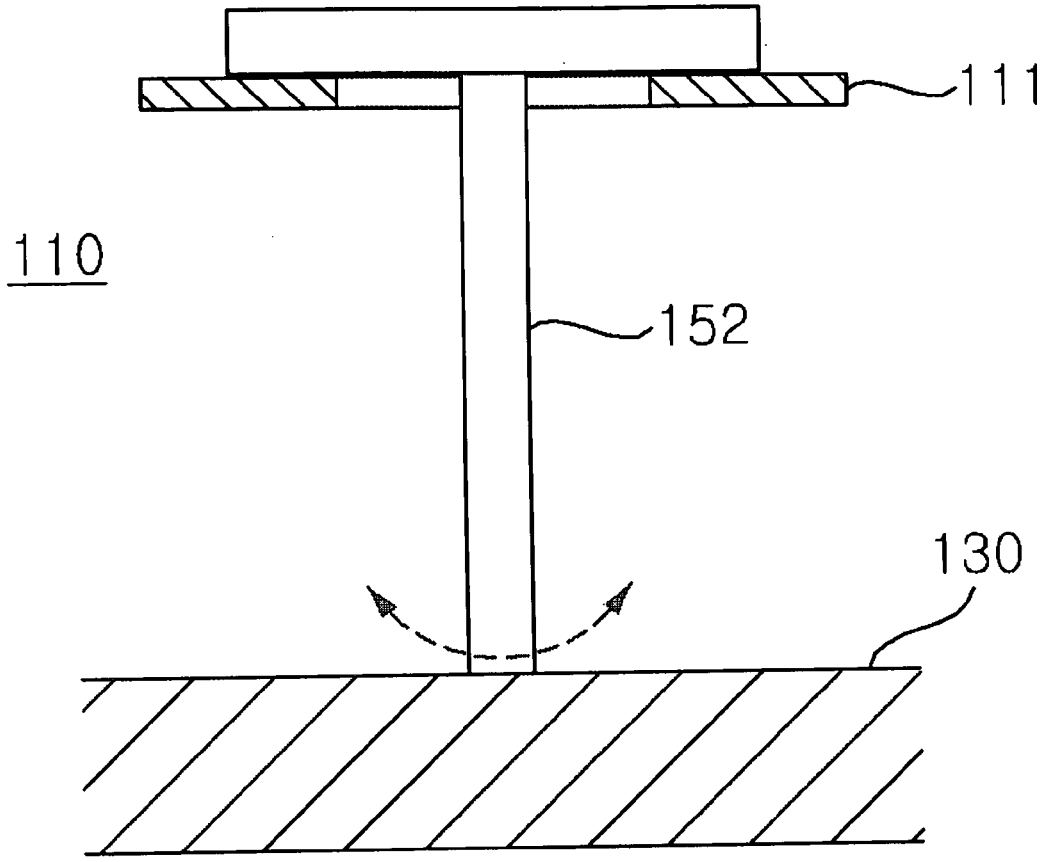
FIG. 4 illustrates a connector of a fabric treatment apparatus according to another exemplary embodiment of the present invention.

FIG. 4 illustrates a connector 152 of a fabric treatment apparatus according to another exemplary embodiment of the present invention. Referring to FIG. 4, the connector 152 may be formed of an elastic material. The connector 152 may be fixed to a ceiling 111 of a treatment room 110 and a clothes rack 130. Since the connector 152 is formed of an elastic material, the clothes rack 130 may reciprocally move in a linear path.

Figure 5:
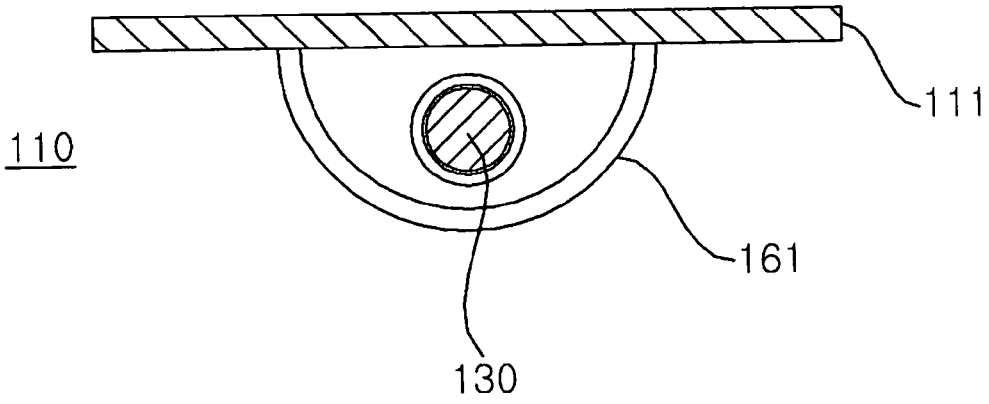
FIG. 5 illustrates a guardrail of a fabric treatment apparatus according to another exemplary embodiment of the present invention.

FIG. 5 illustrates a guardrail 161 of a fabric treatment apparatus according to another exemplary embodiment of the present invention. Referring to FIG. 5, the guardrail 161 may be disposed at the top of a treatment room 110, and may guide a clothes rack 130. The clothes rack 130 may be slidably coupled to the guardrail 161.

The guardrail 161 may be coupled to a ceiling 111 of the treatment room 110. The guardrail 161 may include a circular hole, and thus, the clothes rack 130 may be slidably coupled into the guardrail 161 through the circular hole.

Figure 6:
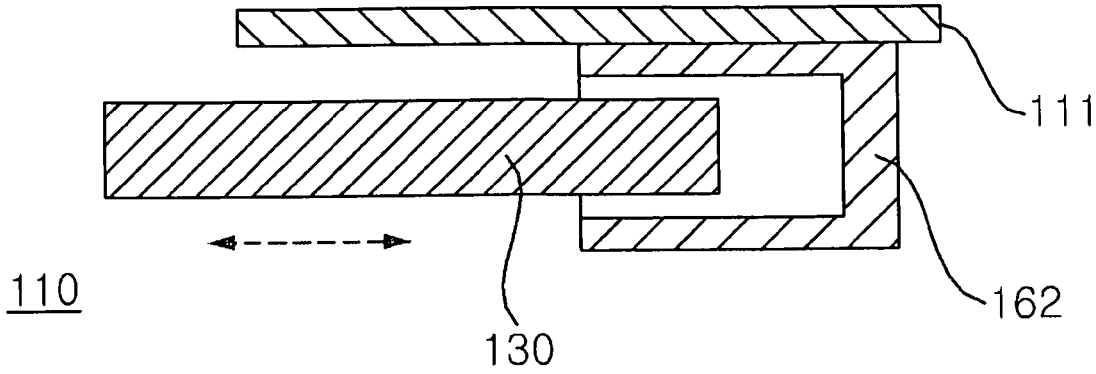
FIG. 6 illustrates a guardrail of a fabric treatment apparatus according to another exemplary embodiment of the present invention.

FIG. 6 illustrates a guardrail 162 of a fabric treatment apparatus according to another exemplary embodiment of the present invention. Referring to FIG. 6, the guardrail 162 may be coupled to a ceiling 111 of a treatment room 110, and one side of a clothes rack 130 may be slidably coupled into the guardrail 162.

Figure 7:
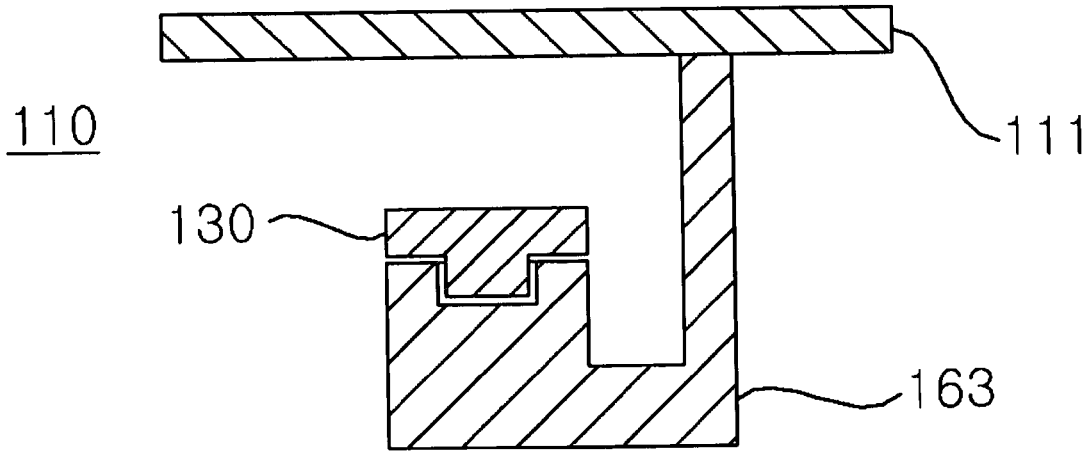
FIG. 7 illustrates a guardrail of a fabric treatment apparatus according to another exemplary embodiment of the present invention.

FIG. 7 illustrates a guardrail 163 of a fabric treatment apparatus according to another exemplary embodiment of the present invention. Referring to FIG. 7, the guardrail 163 may be coupled to a ceiling 111 of a treatment room 110. A clothes rack 130 may be inserted into the guardrail 163 so as to be able to slide along the guardrail 163.

The operation of the fabric treatment apparatuses of the exemplary embodiments of FIGS. 1 through 7 will hereinafter be described in detail.

The user may open the door 20, may hang up the hangers 30 where clothes are hung up on the clothes rack 130, may shut the door 20, and may operate the fabric treatment apparatus.

Then, the heating unit 120 may supply hot air and/or steam into the treatment room 110 according to the type of operating mode of the fabric treatment apparatus. The heating unit 120 may heat air sucked out of the treatment room 110 via the air outlet 121*a*, and may inject the heated air into the treatment room 110 via the hot air inlet 121*b*. In addition, the heating unit 120 may spray steam into the treatment room 110 via the steam injection hole 122.

When the heating unit 120 supplies hot air and/or steam into the treatment room 110, the electromagnets 140 may generate electromagnetic force and may thus reciprocally move the clothes rack 130 in a linear path. More specifically, the first and second electromagnets 140*a* and 140*b* may alternately apply attraction to the clothes rack 130 and may thus reciprocally move the clothes rack 130 in a linear path.

Then, the hangers 30 on the clothes rack 130 may also move reciprocally in a linear path and may thus be able to move the clothes thereon. In this manner, it is possible to improve the efficiency of treatment of the clothes on the hangers 30 with the hot air and/or the steam supplied by the heating unit 120.

According to the present invention, since a clothes rack on which a number of hangers are hung up moves reciprocally inside a fabric treatment apparatus in a linear path, it is possible to improve the efficiency of treating clothes on the hangers. In addition, since the clothes rack can slide out of the fabric treatment apparatus, it is easy to hang up hangers on the clothes rack. Moreover, it is possible to easily move the clothes rack simply using electromagnets and thus to simplify the structure of a fabric treatment apparatus.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A fabric treatment apparatus comprising:

a treatment room adapted to receive laundry to be treated;

a clothes rack disposed in the treatment room, and adapted to support a plurality of hangers to hang the laundry;

one or more electromagnets positioned near each end of and a predetermined distance from each end of the clothes rack, wherein when the one or more electromagnets positioned at a first end of the clothes rack apply an attractive force to the clothes rack, the one or more electromagnets positioned at a second end of the clothes rack also apply a repulsive force such that the clothes rack linearly moves towards the one or more electromagnets positioned at the first end, wherein when the one or more electromagnets positioned at the second end of the clothes rack apply an attractive force to the clothes rack, the one or more electromagnets positioned at the first end of the clothes rack also apply a repulsive force such that the clothes rack linearly moves towards the one or more electromagnets positioned at the second end, wherein the predetermined distance from each end of the clothes rack respectively increases and decreases accordingly to the linear movement of the clothes rack by an amount equal to the linear movement of the clothes rack, and wherein said linear movement produces a reciprocal movement along a linear path; and a heating unit provided below the treatment room, but within the fabric treatment apparatus, and adapted to supply at least one of hot air and steam into the treatment room.

2. The fabric treatment apparatus of claim 1, wherein the electromagnets are disposed at an interior portion of the treatment room.

3. The fabric treatment apparatus of claim 1, wherein the electromagnets are disposed outside of the treatment room.

4. The fabric treatment apparatus of claim 1, wherein the electromagnets are electromagnetic actuators.

5. The fabric treatment apparatus of claim 1, wherein the rack is at least partially formed of a metallic material.

6. The fabric treatment apparatus of claim 1, wherein the rack includes one or more permanent magnets which generate magnetic force in association with the electromagnets.

7. The fabric treatment apparatus of claim 1, further comprising a connecting axial member which connects the rack to a ceiling of the treatment room.

8. The fabric treatment apparatus of claim 7, wherein the connecting axial member is rotatably coupled to the ceiling of the treatment room.

9. The fabric treatment apparatus of claim 7, wherein the connecting axial member is rotatably coupled to the rack.

10. The fabric treatment apparatus of claim 7, wherein the connecting axial member is formed of an elastic material.

11. The fabric treatment apparatus of claim 1, further comprising a guardrail which is disposed at the top of the treatment room and guides movement of the rack, wherein the rack is slidably coupled into the guardrail.

12. The fabric treatment apparatus of claim 1, further comprising:

a door for accessing the fabric treatment apparatus thus providing access to the treatment room to load or unload the laundry, but not providing access inside the heating unit.

13. The fabric treatment apparatus of claim 1, wherein the heating unit further comprises:

an air outlet through which air is ejected from the treatment room;

an air inlet through which heated air is injected into the treatment room; and a steam injection hole through which steam is injected into the treatment room, wherein the heating unit heats the air ejected from the treatment room through the air outlet and then supplies the heated air back into the treatment room through the air inlet, and wherein the heating unit is supplied with water to generate steam which is then injected into the treatment room through the steam injection hole in combination with the heated air.

14. A fabric treatment apparatus comprising:

a treatment room adapted to receive laundry to be treated;

a laundry rack disposed in the treatment room, and adapted to support a plurality of hangers to hang the laundry;

one or more electromagnets disposed on either side of and a predetermined distance from each end of the laundry rack, such that the electromagnets are facing a portion of the laundry rack;

a heating unit provided below the treatment room, but within the fabric treatment apparatus, and adapted to supply at least one of hot air and steam into the treatment room; and a connecting portion configured to couple the laundry rack to a ceiling of the treatment room, such that the laundry rack is adapted to move in a linear path to agitate laundry supported thereon, wherein when the one or more electromagnets positioned at a first end of the clothes rack apply an attractive force to the clothes rack, the one or more electromagnets positioned at a second end of the clothes rack also apply a repulsive force such that the clothes rack linearly moves towards the one or more electromagnets positioned at the first end, wherein when the one or more electromagnets positioned at the second end of the clothes rack apply an attractive force to the clothes rack, the one or more electromagnets positioned at the first end of the clothes rack also apply a repulsive force such that the clothes rack linearly moves towards the one or more electromagnets positioned at the second end, wherein the predetermined distance from each end of the clothes rack respectively increases and decreases accordingly to the linear movement of the clothes rack by an amount equal to the linear movement of the clothes rack, and wherein said linear movement produces a reciprocal movement along a linear path.

15. The fabric treatment apparatus of claim 14, wherein the laundry rack is at least partially formed of a metallic material.

16. The fabric treatment apparatus of claim 14, wherein the connecting portion is rotatably coupled to the ceiling of the treatment room and rotatably coupled to the laundry rack, such that the laundry rack is free to move along the linear path in response to an electromagnetic force applied by the one or more electromagnets.

17. The fabric treatment apparatus of claim 14, wherein the connecting portion is formed of elastic material which is deformable, such that the laundry rack is free to move along the linear path in response to an electromagnetic force applied by the one or more electromagnets.

18. The fabric treatment apparatus of claim 14, wherein the connecting portion is a guardrail having a receiving portion.

19. The fabric treatment apparatus of claim 18, wherein the receiving portion slideably receives the laundry rack, such that the laundry rack is free to move along the linear path in response to an electromagnetic force applied by the one or more electromagnets.

20. The fabric treatment apparatus of claim 19, wherein the receiving portion is open at a side thereof to readily receive the laundry rack laterally therein.

* * * * *